US010556313B2

(12) United States Patent
Giese

(10) Patent No.: US 10,556,313 B2
(45) Date of Patent: Feb. 11, 2020

(54) GRINDING OR SANDING MACHINE

(71) Applicant: Karl Heesemann Maschinenfabriik GmbH & Co. KG, Bad Oeynhausen (DE)

(72) Inventor: Christoph Giese, Herford (DE)

(73) Assignee: Karl Heesemann Maschinenfabrik GmbH & Co. KG, Bad Oeynhausen (DE)

( * ) Notice: Subject to any disclaimer, the term of this patent is extended or adjusted under 35 U.S.C. 154(b) by 114 days.

(21) Appl. No.: 15/792,025

(22) Filed: Oct. 24, 2017

(65) Prior Publication Data

US 2018/0111243 A1 Apr. 26, 2018

(30) Foreign Application Priority Data

Oct. 25, 2016 (DE) ..... 10 2016 120 330

(51) Int. Cl.

| | |
|---|---|
| ***B24B 21/10*** | (2006.01) |
| ***B24B 21/00*** | (2006.01) |
| ***B24B 21/08*** | (2006.01) |
| ***B24B 21/18*** | (2006.01) |
| ***B24B 7/19*** | (2006.01) |

(52) U.S. Cl.

CPC ..... *B24B 21/10* (2013.01); *B24B 7/19* (2013.01); *B24B 21/006* (2013.01); *B24B 21/08* (2013.01); *B24B 21/18* (2013.01)

(58) Field of Classification Search

CPC ..... B24B 7/06; B24B 7/19; B24B 21/006; B24B 21/06; B24B 21/08; B24B 21/10

See application file for complete search history.

(56) References Cited

U.S. PATENT DOCUMENTS

| | | | | | |
|---|---|---|---|---|---|
| 2,586,848 | A * | 2/1952 | Miller | B24B 21/08 | 451/303 |
| 2,904,937 | A * | 9/1959 | Feurich | B24B 21/00 | 451/303 |
| 3,214,870 | A * | 11/1965 | Elmendorf | B27M 1/003 | 144/329 |
| 3,570,190 | A * | 3/1971 | Rutt et al. | B24B 21/10 | 451/303 |
| 4,084,356 | A * | 4/1978 | Brears | B24B 21/00 | 144/355 |
| 4,628,640 | A * | 12/1986 | Johannsen | B24B 21/14 | 198/811 |

(Continued)

FOREIGN PATENT DOCUMENTS

| | | |
|---|---|---|
| DE | 3402104 A1 | 1/1984 |
| DE | 3402102 A1 | 8/1985 |

(Continued)

*Primary Examiner* — Timothy V Eley
(74) *Attorney, Agent, or Firm* — W & C IP

(57) ABSTRACT

A grinding or sanding machine for grinding or sanding a surface of a workpiece includes a transportation device for transporting a work piece, a revolving grinding or sanding belt, and at least one pressure beam for exerting a pressure toward the transportation device. A plate is provided that is movable in a plane perpendicular to the direction in which pressure is exerted. The plate is disposed between the belt and the pressure beam. A drive device randomly moves the plate in plate movement directions in terms of either or both direction and speed.

11 Claims, 2 Drawing Sheets

(56) References Cited

U.S. PATENT DOCUMENTS

Figure 1:
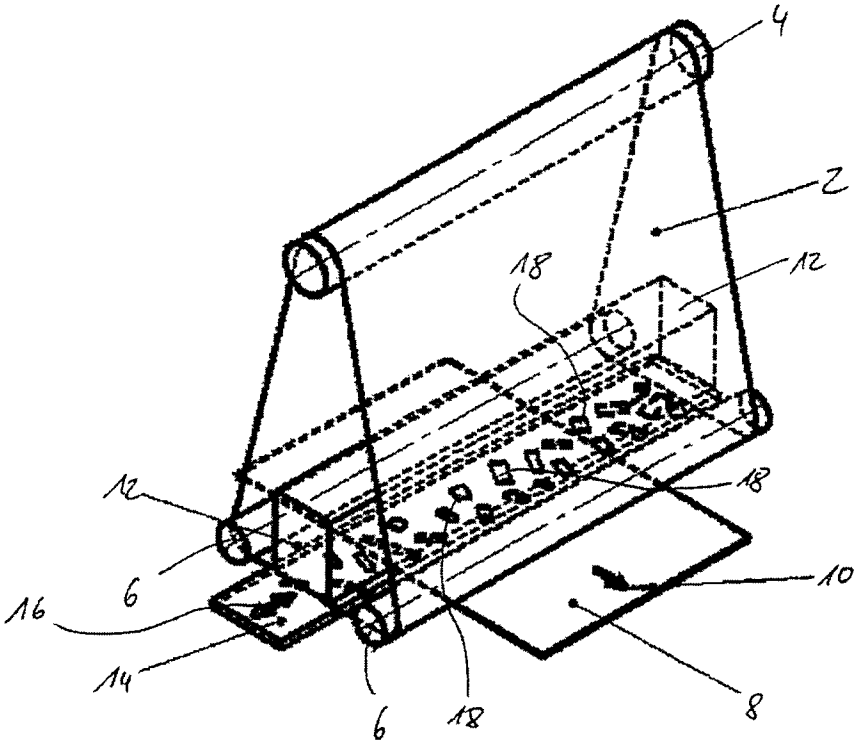

| | | | | |
|---|---|---|---|---|
| 4,839,994 | A * | 6/1989 | Heesemann | B24B 49/10 356/606 |
| 6,001,004 | A * | 12/1999 | Botteghi | B24B 21/04 451/167 |
| 7,052,380 | B2 * | 5/2006 | Weber | B24B 21/06 451/299 |
| 7,241,207 | B2 * | 7/2007 | Heesemann | B24B 7/02 451/164 |
| 7,371,159 | B2 * | 5/2008 | Kundig | B24B 21/08 451/300 |
| 8,574,029 | B2 * | 11/2013 | Bettermann | B24B 7/02 451/166 |
| 8,771,037 | B2 * | 7/2014 | Boggs | B24B 21/006 451/5 |
| 9,085,061 | B2 * | 7/2015 | Breitenmoser | B24B 21/08 |
| 10,124,460 | B2 * | 11/2018 | Stagni | B24B 21/08 |
| 2018/0111241 | A1 * | 4/2018 | Giese | B24B 7/19 |
| 2018/0311780 | A1 * | 11/2018 | Moen | B24B 21/08 |

FOREIGN PATENT DOCUMENTS

| | | | |
|---|---|---|---|
| DE | 3933697 | A1 | 4/1991 |
| DE | 102 39 191 | A1 | 3/2004 |
| DE | 10 2011 116 842 | A1 | 4/2013 |
| DE | 11 2012 002 178 | T5 | 3/2014 |

* cited by examiner

GRINDING OR SANDING MACHINE

The invention relates to a grinding or sanding machine for grinding or sanding a surface of a workpiece, wherein the grinding or sanding machine has at least one transportation device for transporting the workpiece in a transportation direction, at least one revolving grinding or sanding belt, and at least one pressure beam for exerting in the direction of the transportation device on the grinding or sanding belt.

Grinding or sanding machines of this type have been known for a long time in the prior art, and are described in DE 34 02 104 A1, for example. Several approaches to achieving, and modifications to, grinding or sanding machines of this type are known in the prior art, by way of which the quality of the grinding or sanding result, that is to say the homogeneity of the sanded surface, is to be improved.

For example, from DE 39 33 697 A1 it is known for the grinding or sanding belt to not be disposed at an angle of 90° in relation to the transportation direction. Combining a plurality of different grinding or sanding apparatuses in order for the surface quality of the sanded surface to be improved are also known.

A grinding or sanding machine in which an activation device which is movable perpendicularly to the advancing direction of the workpiece to be transported is used mainly when an orbiting grinding or sanding means is used is known from DE 102 39 191 A1. The grinding or sanding results are intended to be configured in a more homogeneous manner and the grinding or sanding dust is to be removed from the device in this manner. A similar device is proposed in order for circular grinding or sanding to be prevented in peripheral contours of the workpiece even when another grinding or sanding means is used.

In the meantime, departing from this past view, the grinding or sanding pattern has been discovered as a design element. In certain applications the attempt is made to specifically not initiate as inconspicuous a grinding or sanding pattern as possible, but to cause visual effects and to design a sanded surface by way of a specific arrangement of grinding or sanding marks. A grinding or sanding machine in which the grinding or sanding apparatus is configured so as to be pivotable in relation to the transportation direction in order for grinding or sanding marks which, depending on the position of the grinding or sanding apparatus, point in various directions to be generated, is thus described in DE 10 2011 116 842 A1, for example. However, this results in a relatively high complexity in terms of the apparatus and limits the design potential.

The invention is consequently based on the object of proposing a grinding or sanding machine by way of which a greater diversity of different grinding or sanding marks can be generated.

The invention achieves the object set by providing a grinding or sanding machine according to the preamble of claim 1, said grinding or sanding machine being distinguished in that a plate which is mounted so as to be movable in a plane that is perpendicular to the direction of the exertable pressure is disposed between the grinding or sanding belt and the pressure beam.

The plate is consequently movable in a plane which most typically lies so as to be parallel with the support face of the workpiece and thus typically also so as to be parallel with the surface to be sanded. When the surface of a workpiece is sanded using the grinding or sanding machine according to the invention, the at least one pressure beam exerts a pressure on the plate that lies between the grinding or sanding belt and the pressure beam, said pressure being transmitted to the grinding or sanding belt. On account thereof, the grinding or sanding belt is pressed onto the surface to be sanded. When the plate during this grinding or sanding procedure is now moved in a direction that is perpendicular to the direction of the pressure, that is to say in most cases parallel with the surface to be sanded, a shear force is exerted on the grinding or sanding belt on account thereof, on account of which various grinding or sanding patterns can be created, depending on the direction in which the plate is being moved. As a result of the combination of revolving grinding or sanding belt, movable plate, and pressure beam, the desired result can be achieved.

It has proven advantageous for the plate to have at least one surface with a structure. The structure advantageously has a plurality of depressions and/or elevations which are particularly preferably disposed in a uniform manner. Uniform patterns of elevations or depressions can thus be disposed on at least one surface of the plate, for example. This surface is preferably that side of the plate that faces the grinding or sanding belt and thus also the workpiece to be machined.

It has proven particularly advantageous for the elevations and/or depressions, which form the structure, to be distributed in a non-uniform manner over the surface. Non-uniform manner means in this case in particular that there is no repeating structure or arrangement of the elevations or depressions. The elevations and/or depressions may additionally be configured to be at different heights or depths in order to make the structure even more non-uniform. This is also particularly advantageously configured without any stipulated pattern and perceivable structure, and in particular without repetitions of a particular pattern or of a particular structure.

A structured surface of the plate ensures that the pressure that is exerted by the at least one pressure beam is not transmitted in a homogeneous manner to the grinding or sanding belt, but that said pressure in the regions in which the surface has an elevation is applied more intensely to the grinding or sanding belt than in the region in which the surface has for example a depression. This results in a non-uniform contact pressure of the grinding or sanding belt on the surface to be sanded such that those regions of the surface to be sanded which come into contact with the grinding or sanding belt where the plate has an elevation are more intensely sanded than other regions which come into contact with the grinding or sanding belt where the plate has a depression. If the plate is moved now, these inhomogeneities in the distribution of pressure are displaced such that patterns can be incorporated in the surface to be sanded depending on the direction of movement. The patterns herein depend on the structure in the surface of the plate, on the one hand, and also on the movement that is performed by the plate, on the other hand. In this way, even when a single plate is used, the most varied patterns can consequently be incorporated in the surface to be sanded in that the movement which is executed by the plate during the grinding or sanding procedure is adapted in a corresponding manner.

The structure is preferably composed at least also of elevations which as releasable elements are disposed on the surface of the plate. Said releasable elements can thus be screw-fitted to the surface of the plate, for example, wherein the screw elements engage in the plate, for example, and/or in that the elements that form the elevation engage in each case in a slot such that a displacement of the element in relation to the surface of the plate is possible. In this way, the structure to be engrained by grinding or sanding can be adapted according to requirements by changing the structure of the surface of the plate. Additionally or alternatively thereto, the elements in the position thereof on the surface of the plate can be offset, be replaced by other elements that optionally are shaped in a different manner and/or have a different height, or be re-arranged.

The grinding or sanding machine advantageously has at least one drive device which is specified for moving the plate. It has proven particularly advantageous here for the drive device to be specified for moving the plate in a random direction, in particular not in a cyclic repetitive manner. This is of advantage in particular when non-uniform grinding or sanding patterns that have a chaotic effect are to be generated. A periodically repetitive structure is avoided in this way. Preferably, not only the direction in which the plate is moved herein is selected in a random or quasi-random manner, but also the speed at which the plate is moved, for example. In this way, a further variable is generated and the diversity of the patterns being created and to be produced is thus further increased.

Alternatively or additionally thereto, the drive device is specified for moving the plate in an oscillating manner, in particular in a direction that is perpendicular to the transportation direction. In this way, the desired effect is achieved in a manner that is simple in terms of construction. Moreover, periodically repetitive grinding or sanding patterns can also be incorporated in the surface. Moreover, the pattern created is reproducible since the movement of the plate is also reproducible. But even when non-uniform or even patterns that have a chaotic effect are to be generated, this is possible using a purely oscillating plate, for example, when the plate per se has a non-uniform structure in the surface and/or the position in which the workpiece is introduced into the grinding or sanding machine is varied. Of course, it is possible for a plurality of workpieces by way of the transportation device to be transported through the grinding or sanding machine always at the same position. For example, the workpiece can always be disposed on a periphery of the transportation device. However, of course the position and/or the orientation of the workpiece in relation to the transportation device and thus also in relation to the grinding or sanding belt can also be varied, on account of which other regions of the grinding or sanding belt come into contact with the surface of the workpiece. As a consequence, other elements of the structured surface of the plate also become effective.

The plate is advantageously composed of a metal, in particular preferably of steel. Of course, other materials having adequate cracking properties are also conceivable.

The pressure beam preferably has a plurality of pressure shoes which are disposed beside one another and by way of which a pressure of different intensity can be exerted on different regions of the plate. It has proven particularly advantageous for the entire pressure beam to be formed by a plurality of pressure shoes that are disposed beside one another and which collectively form the pressure beam and advantageously extend across the entire width of the grinding or sanding belt. When dissimilar pressure shoes are present, said pressure shoes can be controlled in particular electronically such that each pressure shoe exerts an individual pressure on that part of the grinding or sanding belt that lies between said pressure shoe and the transportation device. The pressure that exerted on that section of the plate that lies between the grinding or sanding belt and the respective pressure shoe thus also becomes individually adjustable, on account of which the multiplicity of effects can be further increased. It is advantageous herein for the plate to be configured so thin that said plate is capable of transmitting the pushers acting in a dissimilar manner to the grinding or sanding belt.

When the pressure beam is composed of a plurality of pressure shoes that are separately actuatable, said pressure shoes by way of the electrical controller of the device can be actuated such that the individual pressure shoes exert a pressure of different intensity on the underlying plate. This advantageously also takes place without any perceivable pattern and/or perceivable temporal repetitions in that, for example, a random program runs in the electrical controller and the individual pressure shoes exert a randomly selected pressure on the underlying portion of the plate. Random in this case means a sequence of pressures that is to be considered random according to numeric standards, that is to say in reality a sequence of pressures that is to be considered pseudo-random. This distribution of the pressures which are exerted by the pressure shoes in a "random" manner in terms of time and space ensures a likewise random distribution of the grinding or sanding marks.

Additionally or alternatively thereto, it has proven advantageous for the movement of the plate to also follow a correspondingly "random" movement. Here too, a "random" movement of the plate which does not have any temporal repetitions or other perceivable structures can be achieved by way of a computer program which runs in the electrical controller of the device, for example.

The diversity of grinding or sanding marks that are capable of being generated is almost unlimited by way of combination.

Figure 2:
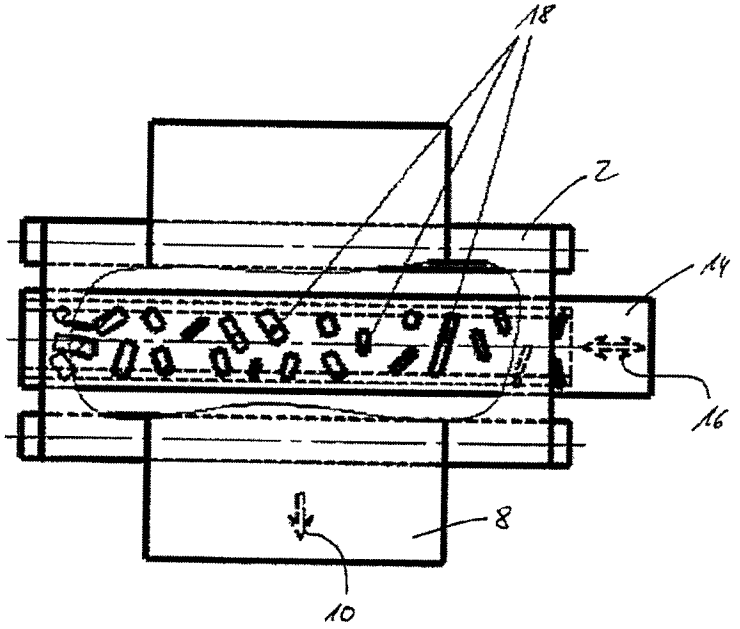

An exemplary embodiment of the present invention will be explained in more detail hereunder with the aid of the two drawings in which:

FIG. 1—shows the schematic illustration of part of a grinding or sanding machine according to a first exemplary embodiment of the present invention; and FIG. 2—shows the schematic plan view of the device according to FIG. 1.

FIG. 1 shows the fragment of a grinding or sanding machine according to a first exemplary embodiment of the present invention. Said grinding or sanding machine has a grinding or sanding belt 2 which in the present case is guided over a drive roller 4 and two deflection rollers 6. The deflection rollers 6 in the exemplary embodiment shown are disposed below the drive shaft 4. Of course, any other of the rollers shown can also be the drive roller 4 by way of which the grinding or sanding belt 2 is driven. The workpiece 8 to be machined is shown in FIG. 1, said workpiece 8 moving on a transportation device in the transportation direction that is represented by the arrow 10. Said workpiece 8 herein comes into contact with the grinding or sanding belt 2.

The device shown in FIG. 1 has a pressure beam 12 which like all other components too, if obscured by another component, is illustrated by dashed lines. It can be seen that the pressure beam 12 in the exemplary embodiment shown extends across the entire width of the grinding or sanding belt 2. A plate 14 which is movable along the directions represented by the double arrow 16 is located between the grinding or sanding belt 2 and the pressure beam 12. The plate 14 in the exemplary embodiment shown can consequently only carry out an oscillating movement in a direction that is transverse to the transportation direction.

The plate 14 has a plurality of elevations 18 which are preferably disposed on the surface of the plate 14 that faces the grinding or sanding belt 2.

The device shown in FIG. 1 is shown in a schematic plan view in FIG. 2, wherein components which by virtue of other components are actually not visible are also illustrated.

The elevations 18 of the plate 14 which again is movable along the direction represented by the double arrow 16 can be seen. The grinding or sanding belt 2 comes into contact with the workpiece 8 which is movable along the transportation direction that is represented by the arrow 10.

LIST OF REFERENCE SIGNS

2 Grinding or sanding belt
4 Drive roller
6 Deflection roller
8 Workpiece
10 Arrow
12 Pressure beam
14 Plate
16 Double arrow
18 Elevation

The invention claimed is:

1. Grinding or sanding machine for grinding or sanding a surface of a workpiece, comprising:

at least one transportation device for transporting the workpiece in a transportation direction;

at least one revolving grinding or sanding belt;

at least one pressure beam for exerting a pressure in a direction towards the transportation device on the grinding or sanding belt;

a plate mounted so as to be movable in a plane that is perpendicular to the direction in which the at least one pressure beam exerts pressure, wherein the plate is disposed between the grinding or sanding belt and the at least one pressure beam, and wherein the plate is moveable in moving directions which are different from the transportation direction of the at least one transportation device, and at least one drive device which is configured for moving the plate randomly in the moving directions in terms of either or both direction and speed.

2. The grinding or sanding machine according to claim 1, wherein the plate has at least one surface with a structure.

3. The grinding or sanding machine according to claim 2, wherein the structure has a plurality of depressions and/or elevations.

4. The grinding or sanding machine of claim 3 wherein the plurality of depressions and/or elevations on the surface are disposed in a uniform manner.

5. The grinding or sanding machine according to claim 1, wherein the at least one drive device moves the plate in moving directions in a non-cyclic or non-repetitive manner.

6. The grinding or sanding machine according to claim 1 wherein the at least one drive device is configured for moving the plate in an oscillating manner.

7. The grinding or sanding machine according to claim 1 wherein the at least one drive device is configured for moving the plate in a direction that is perpendicular to the transportation direction.

8. The grinding or sanding machine according to claim 1 wherein the plate is metal.

9. The grinding or sanding machine according to claim 8 wherein the metal is steel.

10. The grinding or sanding machine according to claim 1 wherein the at least one pressure beam has a plurality of pressure shoes which are disposed beside one another.

11. The grinding or sanding machine according to claim 10 wherein the plurality of pressure shoes are configured to permit a pressure of differing intensity to be exerted at different regions of the plate.

* * * * *